US006957716B1

(12) United States Patent
Norris

(10) Patent No.: US 6,957,716 B1
(45) Date of Patent: Oct. 25, 2005

(54) EMERGENCY STAIRWAY ESCAPE APPARATUS FOR WHEELCHAIRS

(76) Inventor: Robert E. Norris, 411 Cheer Ct., Bear, DE (US) 19701

( * ) Notice: Subject to any disclaimer, the term of this patent is extended or adjusted under 35 U.S.C. 154(b) by 61 days.

(21) Appl. No.: 10/613,941

(22) Filed: Jul. 7, 2003

Related U.S. Application Data

(60) Provisional application No. 60/444,230, filed on Feb. 3, 2003.

(51) Int. Cl.[7] ..... A62B 1/20

(52) U.S. Cl. ..... 182/48; 182/49; 414/537; 14/69.5; 296/61

(58) Field of Search ..... 182/48, 218, 223, 182/49; 414/537; 14/69.5; 296/20, 61; 52/29, 52/182, 184, 185, 186, 198

(56) References Cited

U.S. PATENT DOCUMENTS

| | | | | | |
|---|---|---|---|---|---|
| 4,121,695 | A | * | 10/1978 | Carpenter | 414/539 |
| 4,345,669 | A | * | 8/1982 | Noall | 187/201 |
| 4,488,693 | A | * | 12/1984 | Brandt et al. | 244/116 |
| 4,539,781 | A | * | 9/1985 | McCoy | 52/183 |
| 4,674,601 | A | * | 6/1987 | Benjamin | 414/680 |
| 4,761,847 | A | | 8/1988 | Savage et al. | |
| 4,913,615 | A | | 4/1990 | Ward | |
| 5,020,960 | A | * | 6/1991 | Provenson | 414/494 |
| 5,062,174 | A | | 11/1991 | DaSalvo | |
| 5,325,558 | A | | 7/1994 | Labreche | |
| 5,476,155 | A | | 12/1995 | Nakatani et al. | |
| 5,535,848 | A | * | 7/1996 | Giuliano et al. | 182/49 |
| 5,553,548 | A | * | 9/1996 | Eaton | 104/183 |
| 5,612,515 | A | * | 3/1997 | Eisen | 177/126 |
| 5,735,088 | A | | 4/1998 | Hashino | |
| 5,769,593 | A | * | 6/1998 | Buffaloe | 414/537 |
| 6,009,587 | A | * | 1/2000 | Beeman | 14/69.5 |
| 6,430,769 | B1 | | 8/2002 | Allen | |
| 6,616,396 | B2 | * | 9/2003 | Sternberg | 414/538 |
| 6,695,565 | B1 | * | 2/2004 | Franchuk | 414/537 |
| 2003/0234139 | A1 | * | 12/2003 | Burch | 182/49 |

* cited by examiner

*Primary Examiner*—Bruce A. Lev
(74) *Attorney, Agent, or Firm*—John D. Gugliotta; P. Jeff Martin; Olen L. York, III

(57) ABSTRACT

An emergency stairway escape apparatus permitting wheelchairs to egress a multi-story building via a stairway comprises a ramp platform of sufficient width to cover at least half of each stair tread and of sufficient length to span from an upper landing to a lower landing of said stairway. A latch is mounted to an outward wall for impinging the ramp platform in a stowed position and releasing the ramp platform to a deployed position. A plurality of hinges are used for affixing an edge of the ramp platform to the outward wall and permit an arcuate release of the ramp platform to a deployed position. A motion retarding reel is mounted to an upper landing wall, the reel comprising high strength cable outwardly dischargeable in a linear manner and self-retracting, the cable comprising a hook attachable to a wheelchair, the reel controlling ascent and descent along the ramp platform.

3 Claims, 2 Drawing Sheets

EMERGENCY STAIRWAY ESCAPE APPARATUS FOR WHEELCHAIRS

RELATED APPLICATIONS

This application claims the benefit of U.S. Provisional Application No. 60/444,230, filed on Feb. 03, 2003.

BACKGROUND OF THE INVENTION

1. Field of the Invention

The present invention relates generally to a temporary ramp for wheelchair use and, more particularly, to an engageable staircase ramp apparatus comprising a hinged flat inclined ramp which folds over a staircase for use and a wall-mounted self retracting and descension device adapted for attachment to a conventional wheelchair to facilitate a controlled descent.

2. Description of the Related Art

Recent events have illustrated the vulnerabilities those that use wheelchairs have when trying to leave a multi-story building when elevators are not available. The only means for escape is that others carry them, and possibly their wheelchair, down the stairs. Of course, this task is physically difficult, takes precious time and may block the stairway from use by others. These risks are also present to those who may be using an electric-assist scooter, as well. These dangers are not only present in hi-rise buildings, but any multi-story building that employs elevators for egress for wheelchair bound users. This is especially true in hospitals, nursing homes and other locations where wheelchair bound users are prevalent.

A search of the prior art did not disclose any patents that read directly on the claims of the instant invention; however, the following references were considered related:

U.S. Pat. No. 4,761,847, issued in the name of Savage et al., discloses a folding ramp comprising a plurality of rectangular panels adjoined by pivoting hinges for foldable adjustment and provided with a cable hinge system to provide structural support to the ramp;

U.S. Pat. No. 4,913,615, issued in the name of Ward, discloses a hinge and ramp assembly comprising an underlying pair of hinge plates and an overlying pair of ramps, wherein the hinge plates support the ramps;

U.S. Pat. No. 5,062,174, issued in the name of DaSalvo, discloses a portable ramp for loading off-road vehicles onto pickup trucks, wherein the ramp comprises a plurality of ramp panels joined at lateral edges by hinges for foldable connection therebetween;

U.S. Pat. No. 5,325,558, issued in the name of Labreche, discloses a wheelchair ramp apparatus comprising a pair of track members coupled by an adjustable connector link that establishes the desired width of the track members;

U.S. Pat. No. 5,476,155; issued in the name of Nakatani et al., discloses a stairway lift comprising a guide means formed along a stairway that connects a downstairs level to an upstairs level (and vice versa), the guide means supporting a traction means and a basket carrier;

U.S. Pat. No. 5,735,088, issued in the name of Hashino, discloses a staircase hoist for wheelchair users, said hoist comprising a hoist carrier plate that the wheelchair is mounted to, guide rails positioned in vertically parallel arrangement and brackets for maintaining the positioning, a drive motor for moving the mounted wheelchair either up or down a flight of steps/stairs;

U.S. Pat. No. 6,009,587, issued in the name of Beeman, discloses a folding ramp comprising at least two ramp members pivoted together and having an underside with a plurality of bars and/or rods to add strength and structural rigidity to the ramp; and U.S. Pat. No. 6,430,769, issued in the name of Allen, discloses a wheelchair ramp assembly having a keyway joint that is foldably compactible.

Consequently, there exists a need for a means by which disabled individuals in wheelchairs can leave multi-story buildings with or without assistance by way of steps/stairs.

SUMMARY OF THE INVENTION

It is therefore an object of the present invention to provide an improved temporary ramp for wheelchair use.

It is a feature of the present invention to provide an engageable staircase ramp apparatus comprising a hinged and flat inclined ramp which folds over a staircase for use and a wall-mounted self-retracting descension device adapted for attachment to a conventional wheelchair to facilitate a controlled descent.

Briefly described according to one embodiment of the present invention, an apparatus is provided that permits people in wheelchairs to egress a multi-story building using conventional stairs. A ramp is provided against the wall of the stairs directly under the handrail. In the event that a wheelchair bound user needs to leave the building and an elevator is not available, the user simply releases a latch and the ramp, attached with hinges to the wall, falls in to place. The ramp will then cover half or all of each stair tread. Next, the user attaches a VELCRO® strap to the user's body or cable with a hook to the rear of the wheelchair. The strap or cable is connected to a pre-tensioned and self-retracting reel, fastened to the stairway wall, allowing the user to roll down the ramp in a controlled manner. At the next landing, the user unhooks the cable and repeats the above process on the next set of stairs if needed. Since the invention may only covers one-half of the stairs, the remaining half may remain available to foot traffic.

The use of the present invention allows disabled individuals confined to wheelchairs to quickly leave multi-story building via the stairs, in a manner which is quick, easy, efficient and safe for pedestrians and wheelchair users.

| DESCRIPTIVE KEY | |
|---|---|
| 10 | emergency stairway escape apparatus for wheelchairs |
| 15 | typical stairway |
| 20 | upper landing |
| 25 | lower landing |
| 30 | treads |
| 35 | risers |
| 40 | ramp in stowed position |
| 45 | outward wall |
| 50 | handrail |
| 55 | hinges |
| 60 | quick-release latch |
| 65 | first motion direction arrow |
| 70 | ramp in deployed position |
| 75 | anti-rollover edge |
| 80 | motion retarding reel |
| 85 | upper landing wall |
| 90 | wheelchair |
| 95 | high-strength cable |
| 100 | captive hook |
| 105 | second motion direction arrow |

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
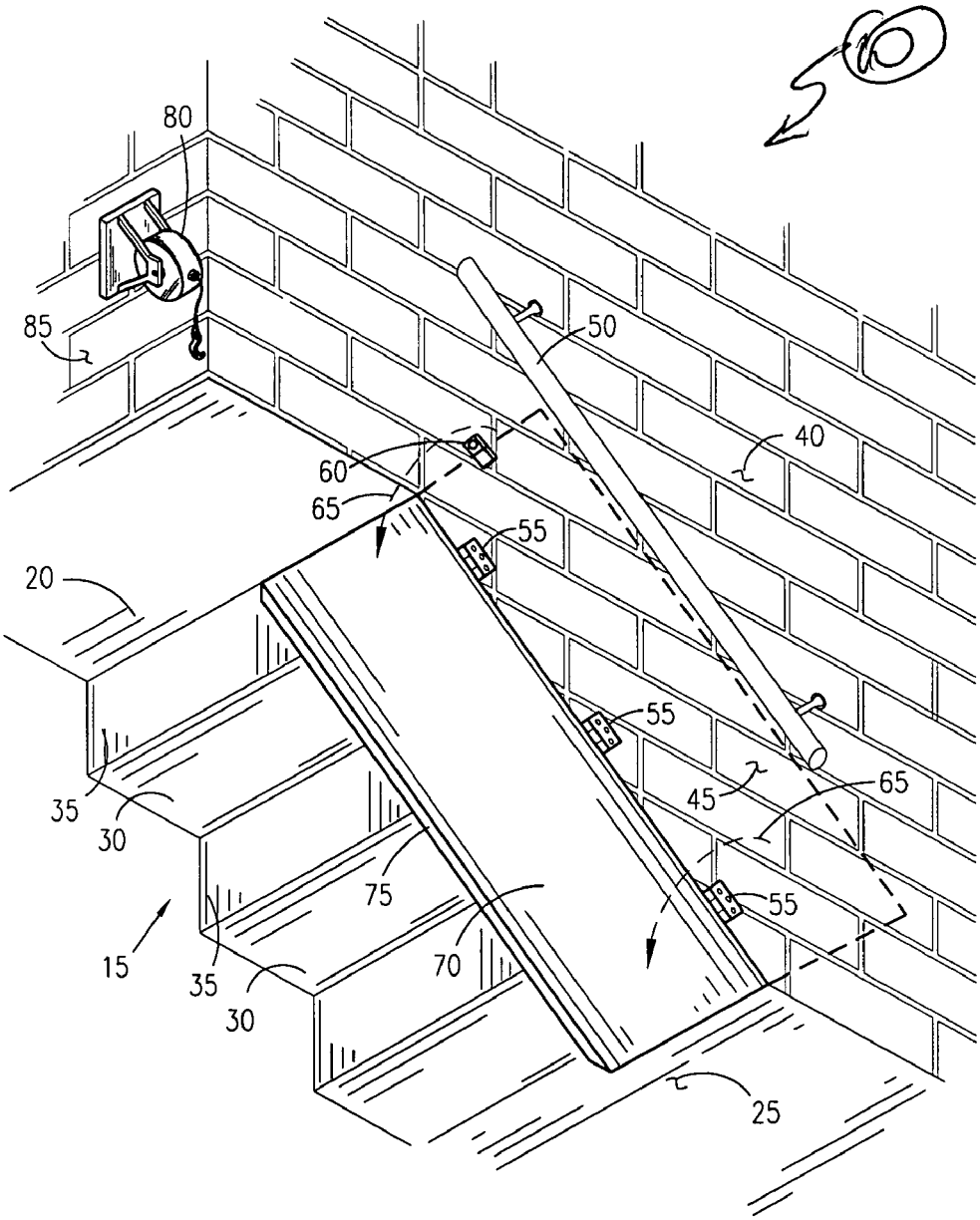
FIG. 1 is an isometric view of the emergency stairway escape apparatus for wheelchairs 10 shown in an installed state in a typical stairway, according to the preferred embodiment of the present invention.
Figure 2:
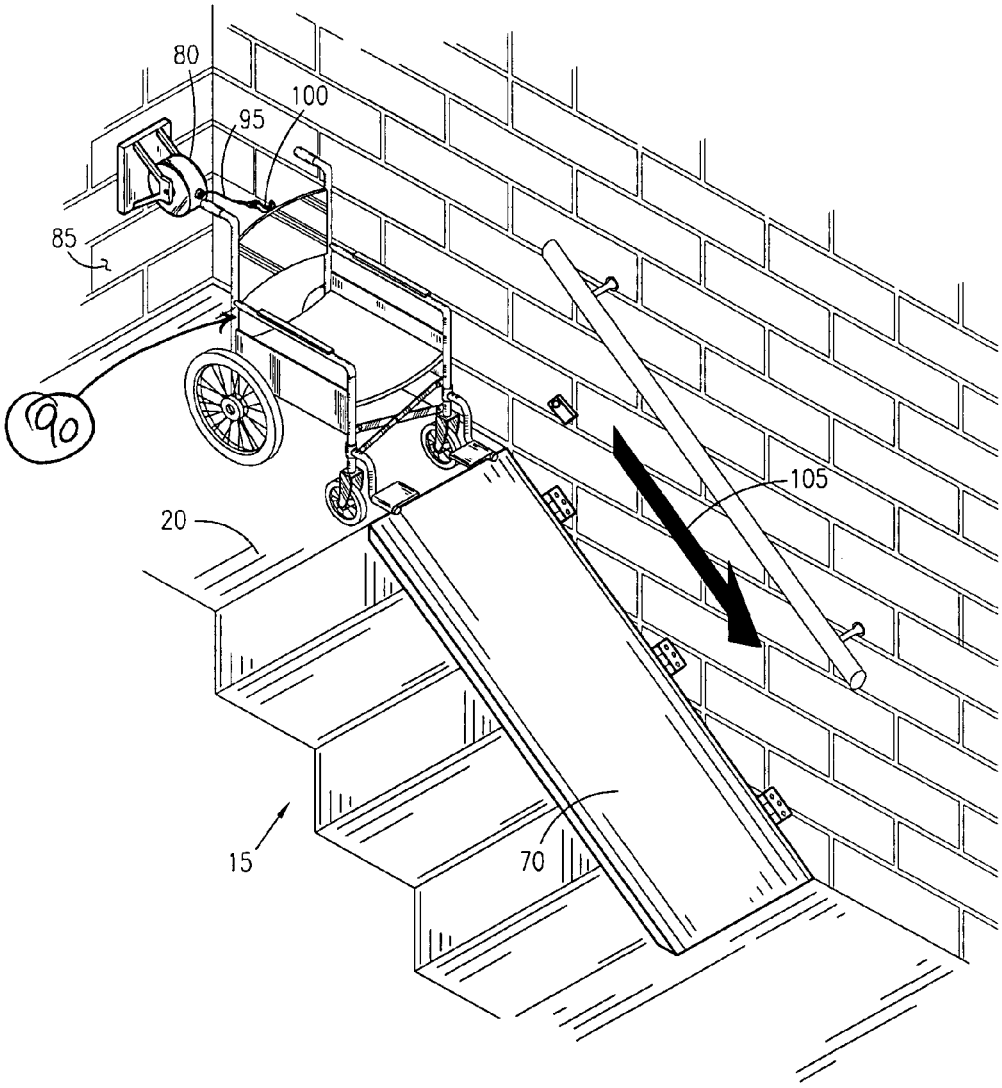
FIG. 2 is an isometric view of the emergency stairway escape apparatus for wheelchairs 10 shown in an utilized state with a wheelchair.

The best mode for carrying out the invention is presented in terms of its preferred embodiment, herein depicted within the FIGS. 1 and 2.

1. Detailed Description of the Figures

Referring now to FIG. 1, an isometric view of the emergency stairway escape apparatus for wheelchairs 10, according to the preferred embodiment of the present invention is disclosed. The emergency stairway escape apparatus for wheelchairs 10 is installed in a typical stairway 15, envisioned to be a closed stairwell, such as those found in a commercial multi-story building, encased by fire walls on all sides. However, it should be noted that the emergency stairway escape apparatus for wheelchairs 10 will work on any straight stairway, and as such, should not be interpreted as a limiting factor of the present invention. In this arrangement, an upper landing 20 is provided at the uppermost portion of the conventional stairway 15, and a lower landing 25 is provided at the lowermost portion of the typical stairway 15. A series of treads 30 and risers 35 are provided in a quantity as necessary to interconnect the upper landing 20 and lower landing 25. A ramp in stowed position 40 is provided along an outward wall 45 such that its width occupies the space from the base of the outward wall 45 to the area immediately under a handrail 50. An edge of the ramp is secured to the outward wall 45 by a series of hinges 55 as shown. The ramp in stowed position 40 is held captive at the upper landing 20 by a quick-release latch 60. Upon activation or release of the quick-release latch 60, the ramp in stowed position 40 will fall in an arc defined by a first directional arrow 65, and as anchored by the hinges 55. At the completion of motion, the ramp in stowed position 40 becomes a ramp in deployed position 70. The ramp in deployed position 70 occupies approximately one-half of the width of the treads 30 and the risers 35, thus allowing use of the ramp in deployed position 70 on one-half of the conventional stairway 15, while foot traffic can continue on the uncovered half of the conventional stairway 15. A lip edge 75 is visible along the outward edge of the ramp in deployed position 70, provided to prevent any object with wheels from rolling on or off any edge of the ramp in deployed position 70 except those in contact with either the upper landing 20 or the lower landing 25. A motion retarding reel 80 is provided on an upper landing wall 85. The functionality of the motion retarding reel 80 will be described in greater detail herein below.

Referring now to FIG. 2, an isometric view of the emergency stairway escape apparatus for wheelchairs 10 shown in an utilized state with a wheelchair 90 is disclosed. The wheelchair 90 is located on the upper landing 20 preparing to descend the ramp in deployed position 70. A high-strength cable 95, of sufficient length to reach the lower landing 25 (as shown in FIG. 1) is deployed from the motion retarding reel 80 which is mounted on the upper landing wall 85 which is perpendicular to the travel path taken on the conventional stairway 15. The captive hook 100 is hooked onto any structural member of the wheelchair 90. The motion of the motion retarding reel 80 is such that the high-strength cable 95 will be outwardly discharged in a linear manner (substantially parallel to the direction of the handrail and the stairway) and is not dependent on the weight of the wheelchair 90 and its occupant. Thus, the wheelchair 90 can descend the ramp in a deployed position 70 to the lower landing 25 (as shown in FIG. 1) in a controlled manner as defined by a second directional arrow 105. When reaching the lower landing 25 (as shown in FIG. 1), the captive hook 100 is unhooked and a self-retracting mechanism in the motion retarding reel 80 (such as a biased coil spring typical to and well known within the art) pulls the high-strength cable 95 and the captive hook 100 back up to the upper landing 20 for use by the next wheelchair 90. It should be noted that while FIG. 2 depicts a wheelchair 90, any wheeled vehicle such as a cart, hand-truck, a stretcher or the like can be used with the emergency stairway escape apparatus for wheelchairs 10 with equal effectiveness. It is envisioned that every landing will possess the retarding reel 80 with cable 95 and hook 100, and along every handrail within the building a deployable ramp.

It is envisioned that other styles and configurations of the present invention can be easily incorporated into the teachings of the present invention, and only one particular configuration will be shown and described for purposes of clarity and disclosure and not by way of limitation of scope.

2. Operation of the Preferred Embodiment

The preferred embodiment of the present invention can be used by the common user in a simple and effortless manner, with minimal training. After procurement of the emergency stairway escape apparatus for wheelchairs 10 it should be installed in the conventional stairway 15 as shown in FIG. 1. It should be noted that a complete system as shown must be installed on each section of stairway. For example, a typical high-rise staircase has a landing at each floor, with an intermediate landing in between. Thus, there are two sections of stair treads 30 and stair risers 35 for each floor. Furthering this concept, a five-story building with the first floor on grade level, would have eight sections of stairway requiring a complete installation of the emergency stairway escape apparatus for wheelchairs 10 as defined in FIG. 1. After installation, suitable training for the building occupants should occur on the use of the emergency stairway escape apparatus for wheelchairs 10. This training should encompass all occupants of the building and not only those confined to wheeled vehicles. This will ensure that help can be provided to all including wheelchair bound visitors who may need to utilize the features of the emergency stairway escape apparatus for wheelchairs 10 without having formal training.

To begin use of the emergency stairway escape apparatus for wheelchairs 10, a user confined to a wheelchair 90 will enter the typical stairway 15 at an upper landing 20. The user will first connect the high-strength cable 95 to the rear of the wheelchair 90 using the captive hook 100. Next, the user will position the wheelchair 90 as shown in FIG. 2. Then, the user will lower the ramp in stowed position 40 by the use of the quick-release latch 60 located along the outward wall 45 immediately below the handrail 50. The ramp in stowed position 40 will drop and become the ramp in deployed position 70 with the aid of gravity. Finally, the user in the wheelchair 90 will guide themselves down the ramp in deployed position 70. The user is prevented from rolling off the long edge of the ramp in deployed position 70 by the lip edge 75. Upon reaching the lower landing 25, the user can unhook the captive hook 100 and associated high-strength cable 95, and safely exit the building should the ground floor be reached, or repeat the above process should more stairs exist. The high-strength cable 95 will self-retract in a controlled fashion to the upper landing 20 to allow use of the emergency stairway escape apparatus for wheelchairs 10 by other building occupants that may need to leave and require the services of the same emergency stairway escape apparatus for wheelchairs 10. It should be noted that half of the treads 30 and risers 35 remain exposed and thus available to foot traffic, and thus the use of the emergency stairway escape apparatus for wheelchairs 10 does not encumber other who may need to traverse the stairs as well.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. A stairway and an emergency escape apparatus adapted to permit people in wheelchairs to egress a multistory building, the apparatus comprising:

a ramp platform of sufficient width covering at least half of each stair tread and of sufficient length to span from an upper landing to a lower landing of said stairway;

a latch mounted to an outward wall of the stairway for impinging said ramp platform in a stowed position and releasing said ramp platform to a deployed position;

a plurality of hinges affixing an edge of said ramp platform to the outward wall; and a motion retarding reel mounted to an upper landing wall of the stairway, said reel comprising high strength cable outwardly dischargeable in a linear manner and self-retracting, said cable comprising a hook attachable to a wheelchair, said reel controlling ascent and descent along said ramp platform.

2. The apparatus of claim 1, wherein said ramp platform further comprises a lip edge to prevent an object with wheels from departing said ramp platform and causing damage and injury.

3. The apparatus of claim 1, wherein said reel outwardly discharges said cable.

* * * * *